US006536235B2

(12) United States Patent
Lovegrove

(10) Patent No.: US 6,536,235 B2
(45) Date of Patent: Mar. 25, 2003

(54) FINGER RING HAVING BEZEL AND REMOVABLE TABLET VISIBLE THERETHROUGH

(76) Inventor: Daniel C. Lovegrove, 174 West Ave., Darien, CT (US) 06820

( * ) Notice: Subject to any disclaimer, the term of this patent is extended or adjusted under 35 U.S.C. 154(b) by 0 days.

(21) Appl. No.: 09/879,179

(22) Filed: Jun. 13, 2001

(65) Prior Publication Data

US 2001/0052245 A1 Dec. 20, 2001

Related U.S. Application Data

(60) Provisional application No. 60/211,970, filed on Jun. 16, 2000.

(51) Int. Cl.[7] ..... A44C 19/00
(52) U.S. Cl. ..... 63/15; 63/1.14; 63/29.1
(58) Field of Search ..... 63/1.11, 1.12, 63/1.14, 1.16, 3, 15, 26, 29.1

(56) References Cited

U.S. PATENT DOCUMENTS

| | | | | | |
|---|---|---|---|---|---|
| 293,875 | A | * | 2/1884 | Henrich | 63/29.1 |
| 392,357 | A | * | 11/1888 | Newman | 63/15 |
| 1,130,917 | A | * | 3/1915 | Meyer | 63/1.12 |
| 1,333,284 | A | * | 3/1920 | Schreiber | 63/15 |
| 1,334,859 | A | * | 3/1920 | Herbert | 63/15 |
| 1,362,995 | A | * | 12/1920 | Hunt | 63/15 |
| 1,972,726 | A | * | 9/1934 | Witte | 63/26 |
| 3,509,734 | A | * | 5/1970 | Lederer | 63/15 |
| 3,835,664 | A | * | 9/1974 | Nesbit | 63/15.6 |
| 4,416,074 | A | * | 11/1983 | Guerrero et al. | 40/364 |
| 4,809,417 | A | * | 3/1989 | Normann, Jr. | 29/896.41 |
| 5,193,360 | A | * | 3/1993 | Lovegrove | 63/15 |
| 5,275,019 | A | * | 1/1994 | Pagani | 63/15 |
| 5,669,240 | A | * | 9/1997 | Lima | 63/15 |

* cited by examiner

*Primary Examiner*—J. J. Swann
*Assistant Examiner*—Andrea Chop
(74) *Attorney, Agent, or Firm*—Shlesinger, Arkwright & Garvey LLP

(57) ABSTRACT

Ring has a removable portion. The removable portion may be a flat object, such as a tablet. The tablet may have a design on it. The tablet may be placed underneath a bezel, which may be clear, and which may be clear and colorless.

23 Claims, 3 Drawing Sheets

FINGER RING HAVING BEZEL AND REMOVABLE TABLET VISIBLE THERETHROUGH

CROSS-REFERENCE TO RELATED APPLICATIONS

This application claims the priority of application Ser. No. 60/211,970, filed Jun. 16, 2000, which is incorporated herein by reference.

FIELD OF THE INVENTION

This invention relates to rings. More specifically the invention relates to finger rings. The invention likewise relates to finger rings having removable portions, such as a tablet on which designs or inscriptions may be provided.

BACKGROUND OF THE INVENTION

Finger rings are known that have compartments for containing articles.

An earlier one of my finger rings is described in U.S. Pat. No. 5,193,360 to Lovegrove. In Lovegrove '360, a variety of ways of providing a removable tablet is shown and described.

Finger rings have been designed which, in addition to their ornamental function, are provided with a compartment into which small photographs or other articles may be placed. Such rings are illustrated in U.S. Pat. No. 1,752,719 issued Apr. 1, 1930, U.S. Pat. No. 2,223,657 issued Dec. 3, 1940, and U.S. Pat. No. 2,357,697 issued Sep. 5, 1944. These patents disclose a variety of ways in which the compartment may be attached to the ring, but none of them provides a ring of conventional appearance wherein the compartment conforms to the contour of the ring and is completely removable from the body of the ring.

None of those rings of Lovegrove '360 includes a removable portion, such as a tablet, which may be removed for close inspection and/or may be retained in the ring while still being capable of being viewed by the user.

Other known rings lack securing elements or means for securely retaining a removable portion of the ring so that the removable portion is not unintentionally separated or lost.

OBJECTS AND SUMMARY OF THE INVENTION

It is an object of the invention to overcome the drawbacks of the prior art.

It is a further objection of the invention to provide a ring having a removable portion, which removable portion may be viewed by the user even when the removable portion has not yet been removed from the remainder of the ring.

A further object of the invention is to provide a ring having a clear portion, which may be also colorless, which both protects the removable portion and allows viewing thereof by the user.

The invention includes a ring having a removable portion which may be viewed by the user whether or not the removable portion has been removed from the remainder of the ring.

The invention likewise includes a ring having a removable tablet which is detachably attached to the remainder of the ring so that the detachable tablet is not inadvertently detached and lost.

The invention likewise includes a finger ring having a magnifying element which enlarges a part of the detachable portion when the detachable portion is in place with the remainder of the ring so that the user may have an enlarged view of the part enlarged by the magnifying element.

It should be understood that relative terms such as left, right, up, and down are for convenience only and are not intended to be limiting.

DETAILED DESCRIPTION OF THE INVENTION

Figure 1:
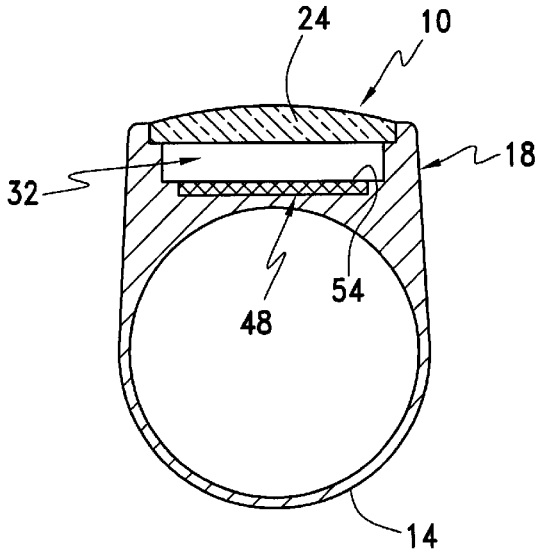
FIG. 1 is a cross sectional side view of a first preferred embodiment of a ring having a magnet glued into a recess at the bottom of the opening or tablet housing in the ring. The magnifying optical lens is shown glued into a corresponding recessed cavity in the ring head.
Figure 2:
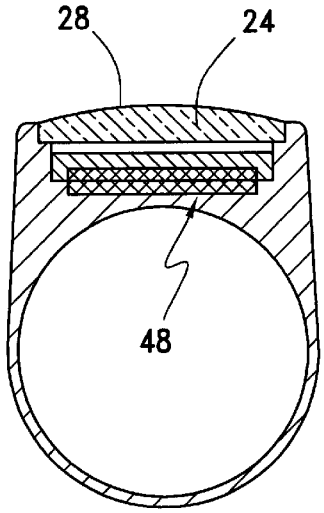
FIG. 2 is a cross sectional side view of the ring of FIG. 1 with the tablet inserted therein; note that the magnet glued in the recess in the bottom of the tablet is magnetically attracted to the magnet respectively glued in a portion of the opening or tablet housing in the ring body.

FIG. 1 shows a ring 10 according to a first preferred embodiment of the invention.

Ring 10 may be a finger ring having a band 14 and a head 18.

A window, such as a bezel 24 may be provided on head 18. A lens, such as a magnifying lens may be provided instead of a non-magnifying bezel. Bezel 24 may include a rounded upper surface 28, and may be made of a substantially clear, colored or colorless material such as glass or a plastic, or a sapphire crystal, for example. It is expected that when a magnifying lens is used, the lens may also be tinted in a variety of colors.

Bezel or lens 24 may be secured in head 18. Bezel 24 may be secured by gluing.

An opening 32 may be provided that is configured for receiving a tablet 40.

Tablet 40 may have a lower portion 42 and a recess 43 defined therein.

A first magnet 44 may be provided in recess 43.

A bottom face 46 of first magnet 44 will typically be provided.

A second magnet 48 may be provided in head 18. A top face 54 of magnet 48 may be selected to cooperatively engage and/or be magnetically attracted to bottom face 46 of first magnet 44. Namely, the first and second magnets 44 and 48 will be selected so as to mutually attract each other so as to retain tablet 40 within opening 32.

First and second magnets 44 and 48 may be secured in place by gluing.

Bezel 24 may have one or more sides 62 and a lower surface 66.

Conveniently, one or both of sides 62 and lower surface 66 may be secured within an opening 70 in head 18 by their engaging a contoured edge 74 of the opening defined in head 18.

An attachment element 80, such as the illustrated bead of glue 80, may be provided on one or all of contoured edge 74, side 62 of bezel 24, or a portion of lower surface 66 of bezel 24. In that manner, attachment element 80 may secure bezel 24 to the remainder of ring 10.

Figure 3:
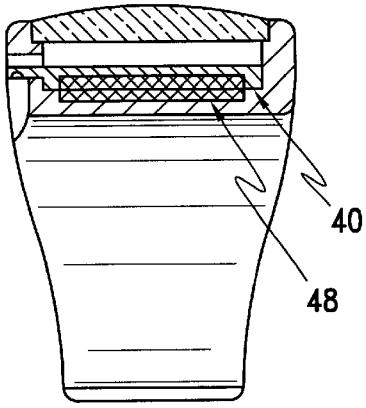
FIG. 3 is a partial cross sectional front view of the ring of FIG. 1 with the tablet inserted therein.
Figure 5:
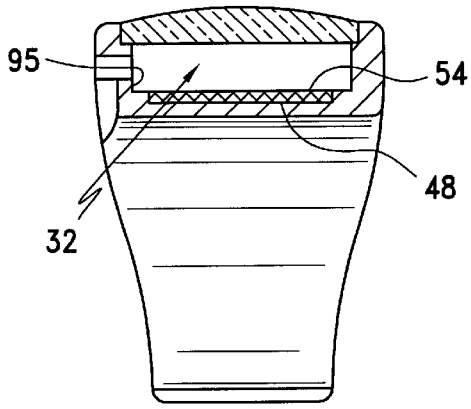
FIG. 5 is a partial cross sectional front view of the ring of FIG. 1 with the tablet removed; the magnet is shown glued into a recess at the bottom of the tablet housing in the ring.
Figure 4:
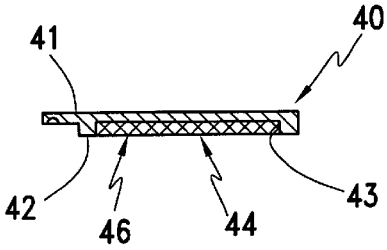
FIG. 4 is a cross sectional side view of the tablet; the magnet is shown glued into the cavity in the bottom of the tablet lower surface.
Figure 6:
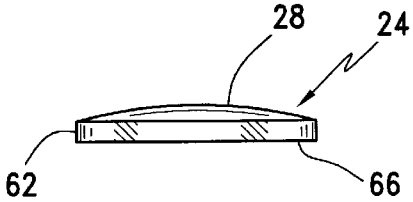
FIG. 6 is a side view of the bezel of FIG. 1.
Figure 7:
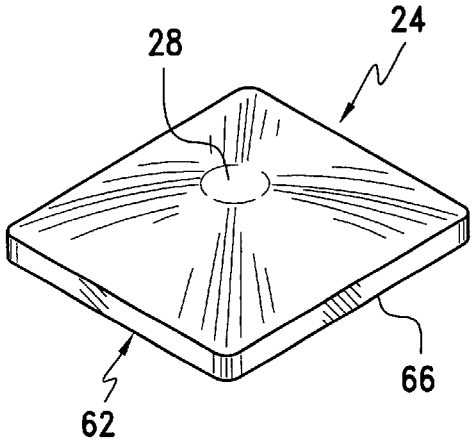
FIG. 7 is a top perspective view of the bezel of FIG. 6.
Figure 8:
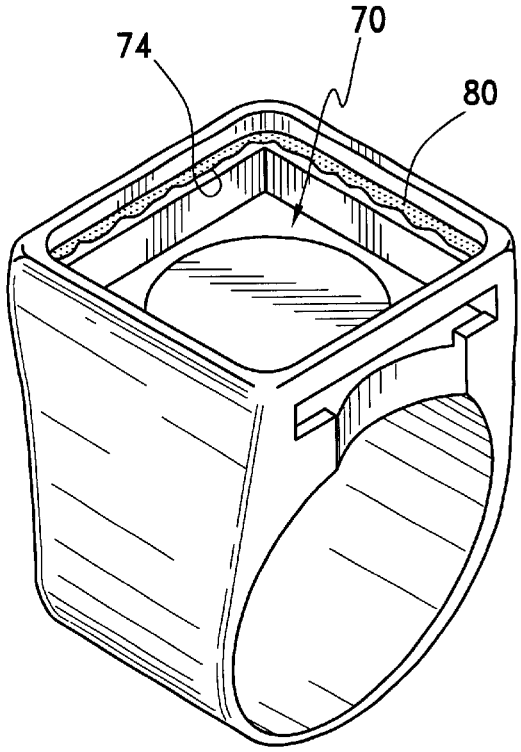
FIG. 8 is a top perspective view of the ring of FIG. 1 with the bezel removed for clarity; glue is shown in place ready to receive and attach the bezel.
Figure 10:
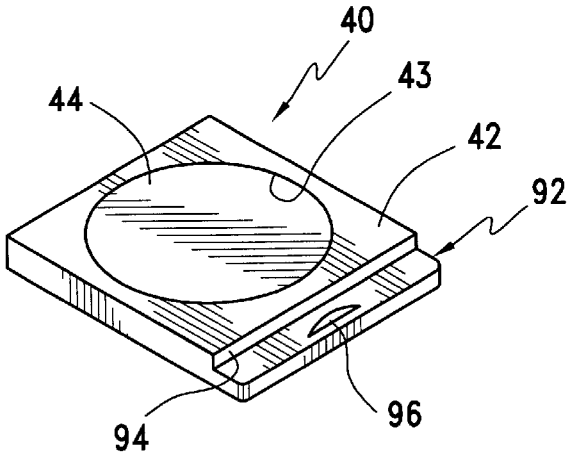
FIG. 10 is a bottom perspective view of the tablet of FIG. 9 showing the tablet in place and having a recessed portion.

Tablet 40 may be provided with a stepped portion 92, such as shown in FIG. 10. Stepped portion 92 may be sufficiently large so as to define a face 94 that assists in retaining tablet 40 in its opening. Such is done by face 94 engaging a mating face 95 of the ring of FIG. 3, for example.

A notch 96 may be provided in stepped portion 92. Notch 96 may be configured for engaging one or more fingernails of a user, or for engaging another implement, for assisting in the removal of tablet 40 from its place within opening 32.

An inscription 98, such as favorite phrase, poem, design, or other decorative element may be provided on one or more of the surfaces of tablet 40.

Figure 9:
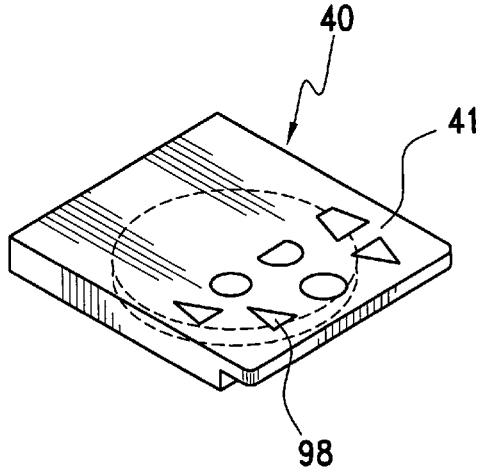
FIG. 9 is a top perspective view of the bezel of FIG. 1 illustrating the case in which an inscription 98 has been applied thereto.

FIG. 9 shows the provision of inscription 98 on upper surface 41 of tablet 40.

Figure 11:
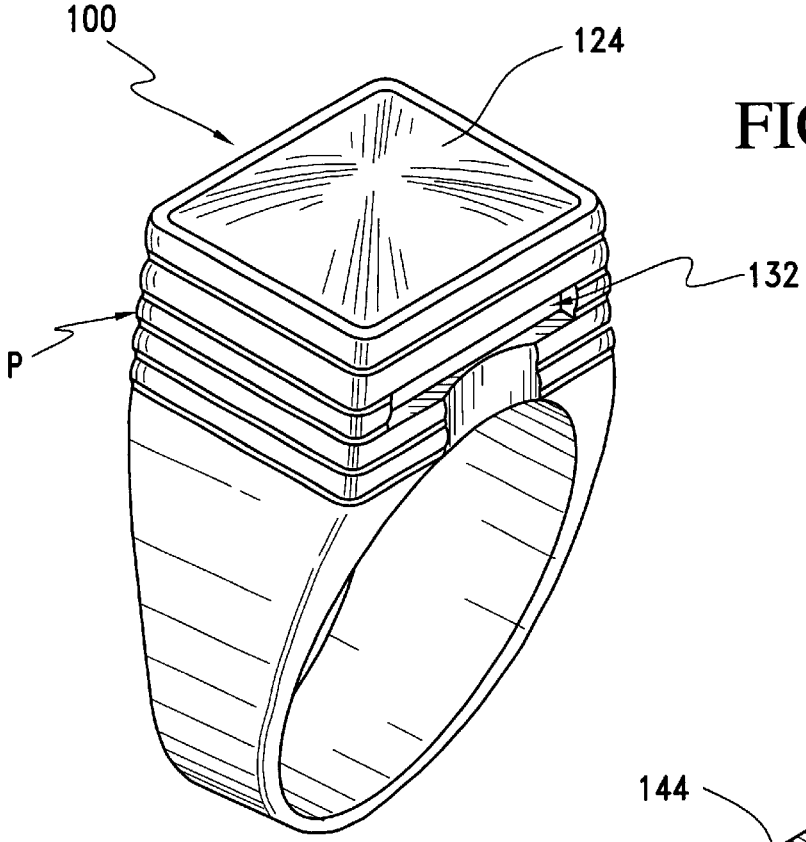
FIG. 11 is a perspective view of a further preferred embodiment of a ring 100 constructed in accordance with the invention, and with the tablet removed.
Figure 12:
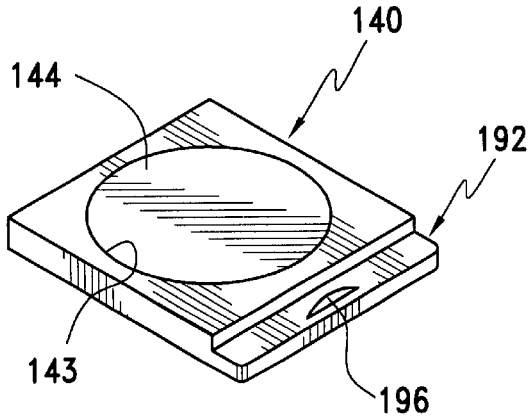
FIG. 12 is a bottom perspective view of the tablet of FIG. 11.

FIGS. 11 and 12 illustrates a further preferred embodiment of a finger ring 100 according to the invention.

Finger ring 100 includes many elements analogous to those of ring 10 of the preferred embodiment of FIGS. 1–10.

Ring 100 includes, for example, a bezel 124, a tablet 140 having a recess 143 receiving a first magnet 144 therein, as well as a corresponding magnet in the head or gand of ring 100, which corresponding magnet is not visible in FIG. 11.

A stepped portion 192 may be provided on tablet 140, as well as a notch 196 to assist in the removal thereon, analogous to the removal of tablet 40 described above.

A decorative portion or pattern P may be provided on ring 100.

Figure 13:
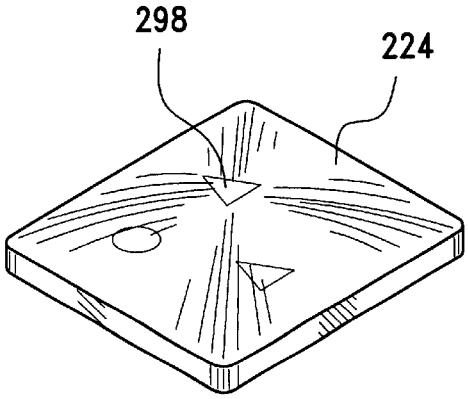
FIG. 13 is a perspective view of another preferred embodiment of the bezel according to invention, in which the bezel has visible indicia disposed therein.

FIG. 13 shows another preferred embodiment of a bezel 224. Bezel or lens 224 may contain a visible indicia 298 embedded in the middle thereof, as shown. Alternately, the visible indicia may be on an upper or lower surface of bezel 224. The visible indicia may be engraved or etched.

It will be appreciated that various materials may be used to make any of the elements of the invention described above.

For example, the glue used to manufacture the rings (e.g., secure bezel 24 within opening 70) may be a 3M (Minnesota, Mining and Manufacturing) product no. 2216(a two(2) part system) type of adhesive.

The magnets may be zinc-plated.

The lens may be provided on a portion of the band.

In the case where bezel 24 is a lens, it may be a flat-backed lens made of a known optical glass BK-7. Such lens may be made of glass, plastic, sapphire crystal, and tinted as desired.

The band and head may be made of any type of metal or plastic. other materials and configurations may be used as set forth in U.S. Pat. No. 5,193,360 to Lovegrove, which is incorporated herein by reference.

While this invention has been described as having a preferred design, it is understood that it is capable of further modifications, and uses and/or adaptations of the invention and following in general the principle of the invention and including such departures from the present disclosure as come within the known or customary practice in the art to which the invention pertains, and as may be applied to the central features hereinbefore set forth, and fall within the scope of the invention or limits of the claims appended hereto.

What is claimed is:

1. A ring, comprising:

a) a band;

b) a head disposed on said band;

c) an opening provided in one of said head and said band, said opening being configured for receiving an object therein;

d) a removable object removably provided inside the opening in said one of said head and band;

e) a first magnet provided on a face of said removable object;

f) an interior face provided inside said one of said head and said band;

g) a second magnet provided on said interior face; and h) said second magnet magnetically attracting said first magnet when said removable object is received inside said opening.

2. A ring as defined in claim 1, wherein:

a) an element is disposed on one of said head and said band, said element being configured for allowing a user to view an object disposed in said opening when an object is provided in said opening.

3. A ring as defined in claim 2, wherein:

a) said element includes a window.

4. A ring as defined in claim 3, wherein:

a) said window includes a sapphire crystal.

5. A ring as defined in claim 3, wherein:

a) said window includes a glass.

6. A ring as defined in claim 3, wherein:

a) said window includes a plastic.

7. A ring as defined in claim 2, wherein:

a) said element includes a bezel.

8. A ring as defined in claim 7, wherein:

a) said bezel includes a sapphire crystal.

9. A ring as defined in claim 2, wherein:

a) said element includes a lens.

10. A ring as defined in claim 9, wherein:

a) said lens is clear.

11. A ring as defined in claim 10, wherein:

a) said lens is colorless.

12. A ring as defined in claim 9, wherein:

a) said lens is tinted.

13. A ring as defined in claim 9, wherein:

a) said lens includes BK-7 optical glass.

14. A ring as defined in claim 9, wherein:

a) an indicia is embedded in the lens.

15. A ring as defined in claim 2, wherein:

a) said object includes a tablet.

16. A ring as defined in claim 15, wherein:

a) said tablet includes a notch configured for being engaged by an object to assist in the removal of said tablet from said opening.

17. A ring as defined in claim 16, wherein:

a) said notch is configured for being engaged by a human fingernail.

18. A ring as defined in claim 15, wherein:

a) said tablet includes a face configured for engaging a portion of the ring for restricting removal of the tablet.

19. A ring as defined in claim 15, wherein:

a) an indicia is provided on said tablet.

20. A ring as defined in claim 1, wherein:

a) said first magnet is received in a recess defined in said object.

21. A ring, comprising:

a) a band;

b) a head disposed on said band;

c) an opening provided in one of said head and said band, said opening being configured for receiving an object therein;

d) a removable object removably provided inside the opening in said one of said head and said band;

e) a stepped portion being provided on the removable object; and f) a mating element provided on said one of said head and said band, the mating element being provided near an outer portion of the opening, the mating element being configured for engaging the stepped portion on the object for retaining the object in the opening when the removable object is provided in the opening.

22. A ring as defined in claim 21, wherein:

a) a magnet is provided on one of the object and one of said head and said band.

23. A ring as defined in claim 22, wherein:

a) a further magnet is provided on the other one of the removable object and said one of said head and said band.

* * * * *